US005752707A

United States Patent [19]

Cottle et al.

[11] Patent Number: 5,752,707

[45] Date of Patent: *May 19, 1998

[54] CUFF-ACTIVATED BRAKE FOR IN-LINE ROLLER SKATE

[75] Inventors: Stefan T. Cottle, Falls Church, Va.; David Geoffrey Peck, 2047 Greenwich St., Falls Church, Va. 22043

[73] Assignee: David Geoffrey Peck, Falls Church, Va.

[ * ] Notice: The term of this patent shall not extend beyond the expiration date of Pat. No. 5,375,859.

[21] Appl. No.: 685,626

[22] Filed: Jul. 24, 1996

Related U.S. Application Data

[60] Provisional application No. 60/001,651 Jul. 28, 1995.

[51] Int. Cl. [6] ..... A63C 17/14

[52] U.S. Cl. ..... 280/11.2; 188/71.1; 280/11.22

[58] Field of Search ..... 280/11.2, 11.22; 188/72.7, 71.1

[56] References Cited

U.S. PATENT DOCUMENTS

| | | | |
|---|---|---|---|
| 4,275,895 | 6/1981 | Edwards . | |
| 4,402,520 | 9/1983 | Ziegler | 280/11.2 |
| 4,633,979 | 1/1987 | Edwards | 188/71.1 X |
| 5,211,409 | 5/1993 | Mitchell et al. . | |
| 5,253,882 | 10/1993 | Mitchell . | |
| 5,280,930 | 1/1994 | Smathers et al. | 280/11.22 X |
| 5,374,070 | 12/1994 | Pellegrini, Jr. et al. . | |
| 5,375,859 | 12/1994 | Peck et al. . | |
| 5,388,844 | 2/1995 | Pellegrini, Jr. et al. . | |
| 5,397,137 | 3/1995 | Pellegrini, Jr. et al. . | |
| 5,401,038 | 3/1995 | Peck et al. . | |
| 5,411,276 | 5/1995 | Moldenhauer . | |
| 5,415,419 | 5/1995 | Bourque . | |
| 5,435,579 | 7/1995 | Pozzobon . | |
| 5,435,580 | 7/1995 | Balbinot et al. . | |
| 5,462,296 | 10/1995 | Pozzobon . | |
| 5,462,297 | 10/1995 | Lee . | |
| 5,465,984 | 11/1995 | Pellegrini, Jr. et al. . | |
| 5,468,004 | 11/1995 | Olson et al. . | |
| 5,470,085 | 11/1995 | Meibock et al. . | |
| 5,478,094 | 12/1995 | Pennestri . | |
| 5,486,011 | 1/1996 | Nelson . | |
| 5,505,468 | 4/1996 | Pozzobon et al. . | |
| 5,505,469 | 4/1996 | Zorzi et al. . | |
| 5,511,804 | 4/1996 | Pellegrini, Jr. et al. . | |
| 5,527,048 | 6/1996 | Conte . | |
| 5,639,104 | 6/1997 | Haldemann | 280/11.2 |

*Primary Examiner*—Brian L. Johnson
*Assistant Examiner*—Michael Mar
*Attorney, Agent, or Firm*—Hoffman, Wasson & Gitler

[57] ABSTRACT

A braking system for in-line skates activated by a cuff articulated to a shell that delivers significant braking power to one or more wheels of the skate in precise and evenly applied amounts without the need for difficult toe-up skating maneuvers. Wheel lockup is avoided by conveying braking force evenly to multiple load-bearing wheels. In a single braking wheel configuration, articulation of the cuff manipulates a lever arm rotating about the axle of the rear wheel by means of a rod attached to the cuff on one end and to the lever arm on the other end. Longitudinal movement of the cuff and the attached lever induces lateral movement of brake discs on either side of the rear wheel into contact with brake pad surfaces fixed to the side walls of the braking wheel. Considerable braking power is produced due to the mechanical advantage achieved by the large range of motion of the lever arm moving the brake discs over a relatively short distance. This braking action may be effected on more than one wheel by means of a transfer lever fixed to the rear wheel lever arm on one end, and to lever arms on the additional braking wheels on the other end. An alternate, two braking wheel configuration is also possible, whereby only the two central wheels employ the braking system.

19 Claims, 8 Drawing Sheets

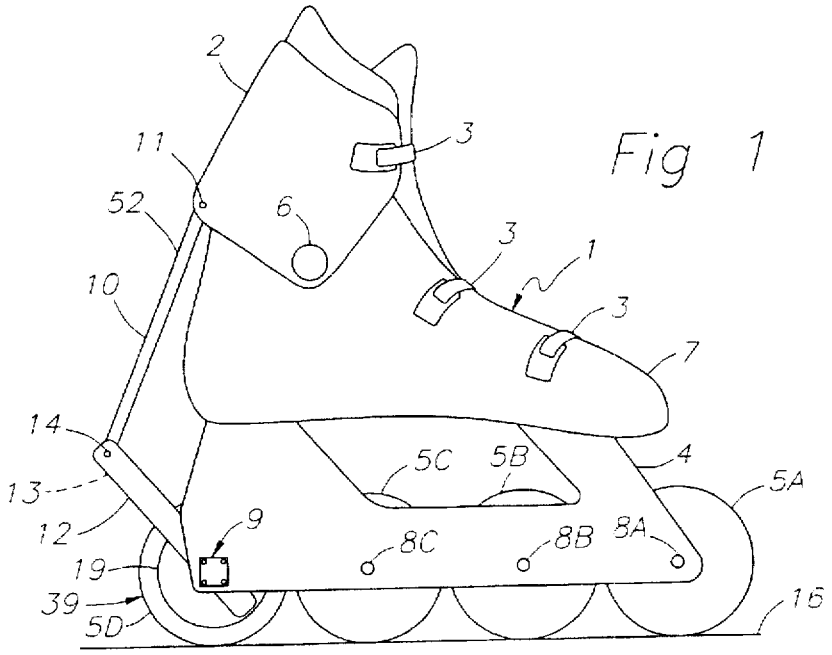
Fig 1
Fig 2
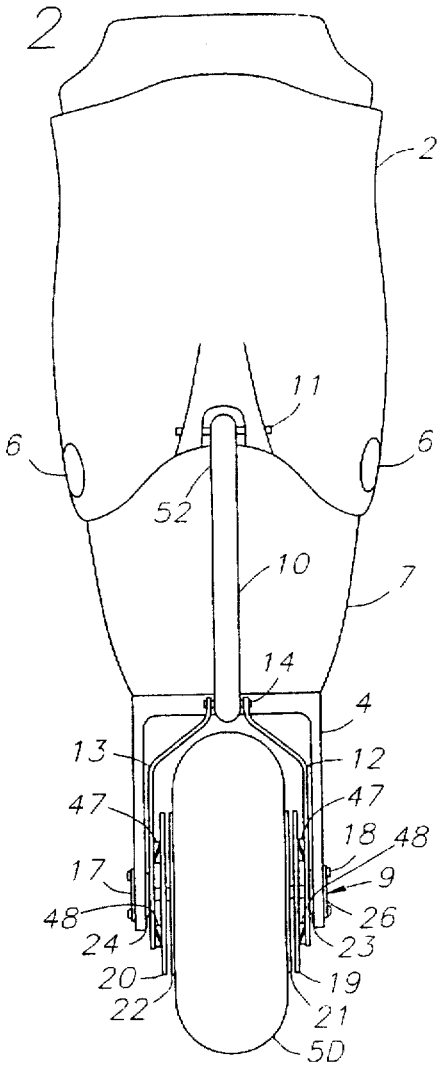
Fig 3
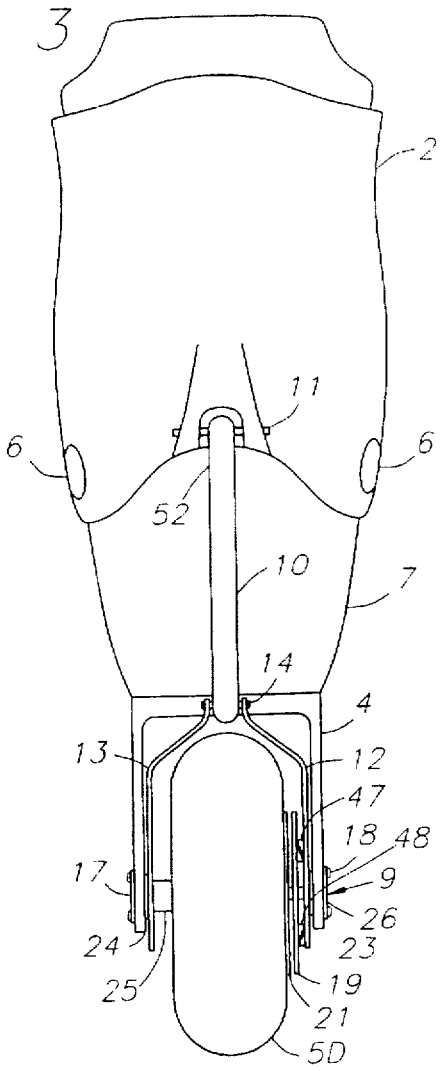

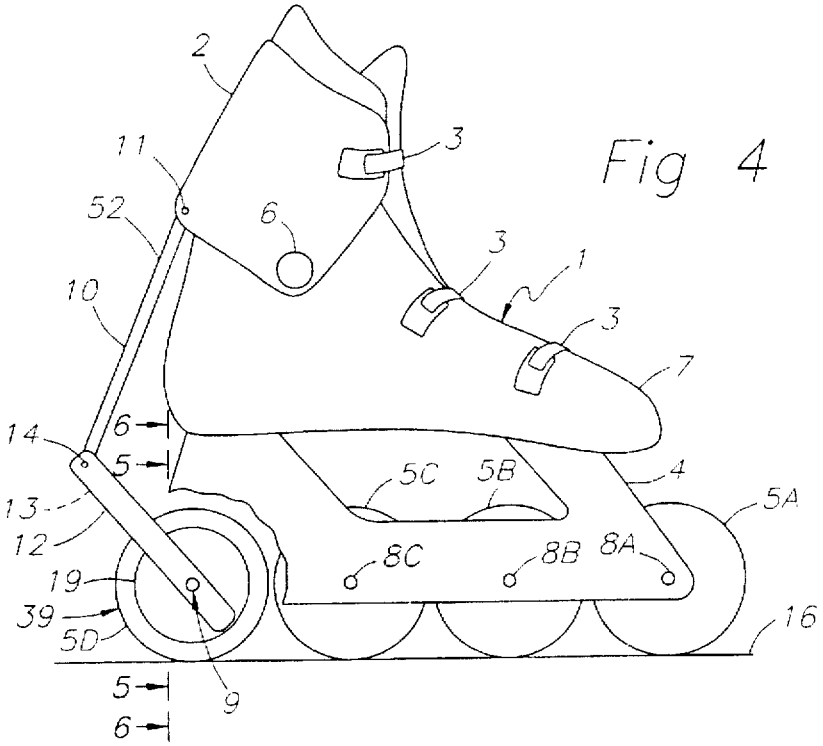
Fig 4
Fig 5
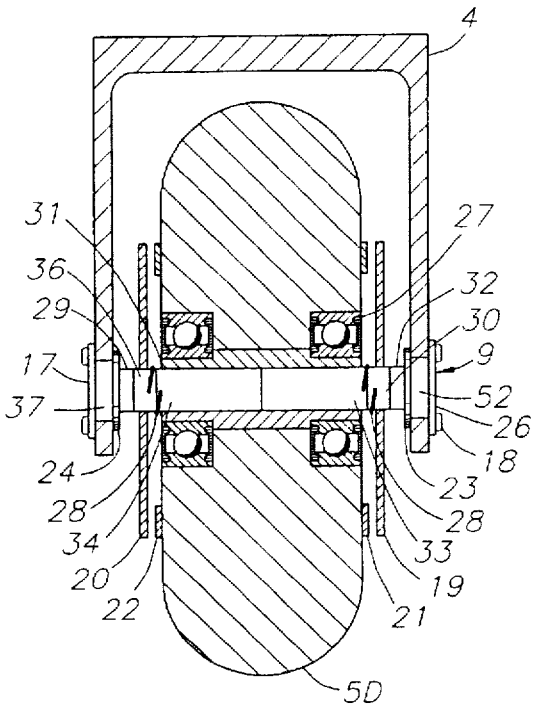
Fig 6
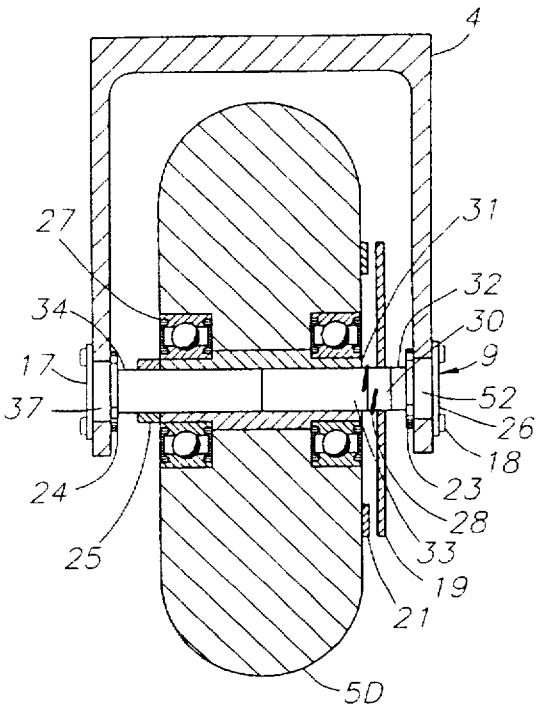

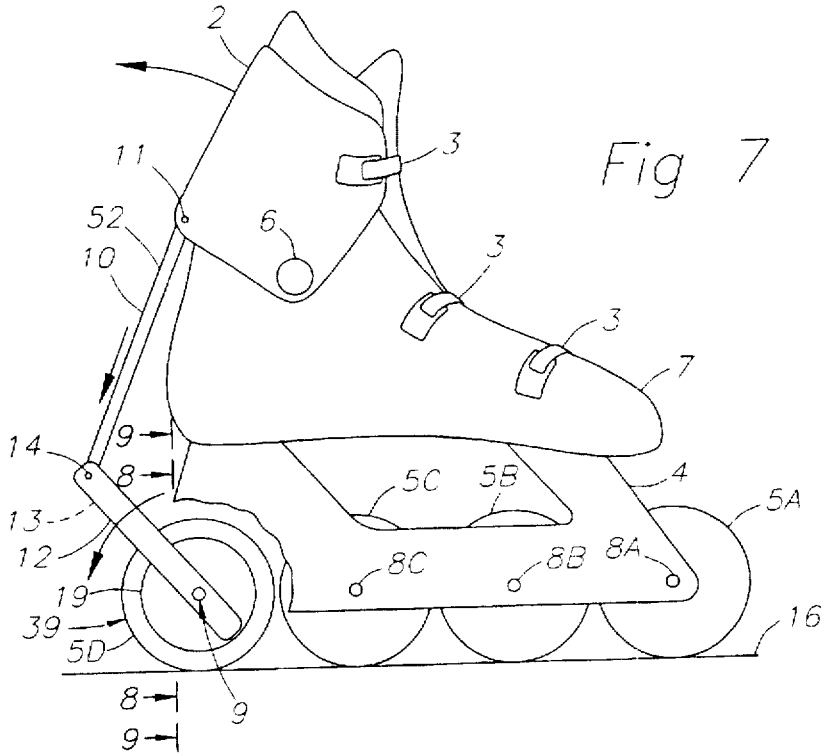
Fig 7
Fig 8
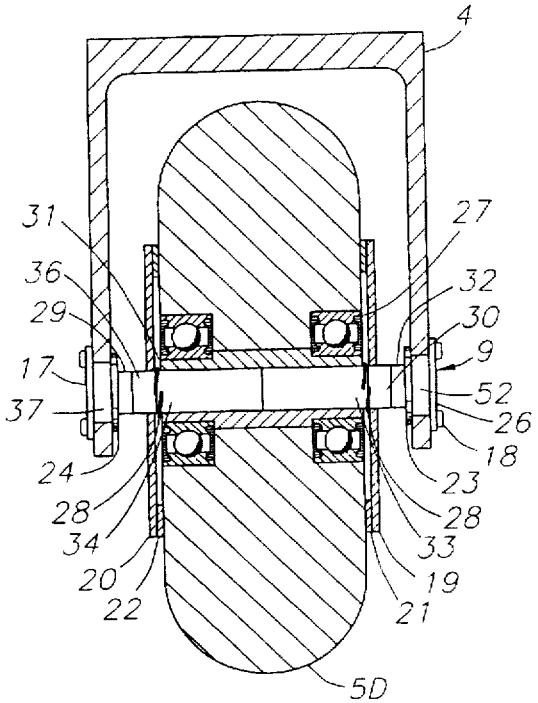
Fig 9
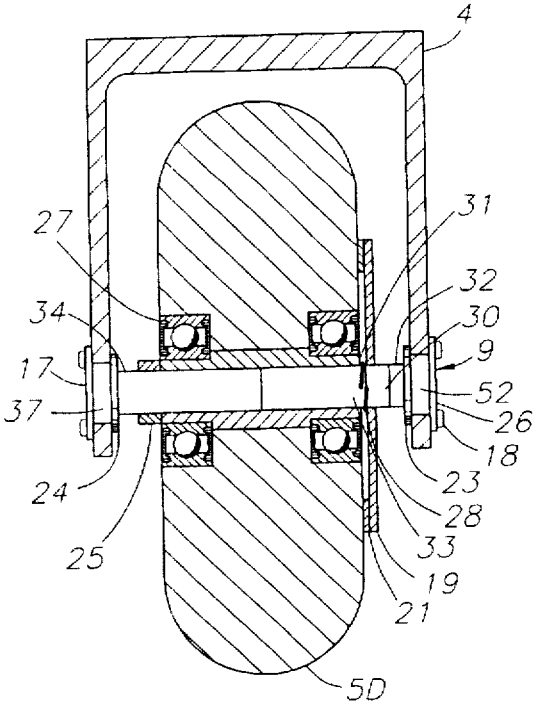

CUFF-ACTIVATED BRAKE FOR IN-LINE ROLLER SKATE

This application claims the benefit of U.S. Provisional Application No. 60/001,651 filed Jul. 28, 1995.

BACKGROUND OF THE INVENTION

Brakes for in-line skates may be divided into three broad categories. Designs of the first category (2,193,685; 4,273,345; 5,028,058; and 5,052,701) induce friction between the skate and road surface by dragging an appendage, generally a rubber pad or snub, along the road. The are operated by lifting the toe of the skate, thereby bringing the snub into contact with the road surface creating friction. Brakes of this type are the most common because they are inexpensive to build but suffer from four serious shortcomings. They create insufficient friction to quickly stop a skater moving at high speed; they provide inadequate control due to variable road surfaces and diminished contact between the wheels and road as the wheels are relieved of weight borne by the brake snub; the brake surface suffers from wear resulting in deteriorating performance of the brake and requires frequent replacement or adjustment, and finally, they interfere with common skating maneuvers such as cross-over and backwards strides because the brake extends far back off the rear wheel. Devices of this type, in other words, suffer from poor performance, inadequate control, unreliability and awkwardness.

The second broad category consists of brakes that mechanically activate a rubber snub extending off the rear wheel. The main advantage to such brakes is that they may be easier to use for beginners and provide superior control by obviating the toe-up maneuver required in conventional skates. Mechanical activation may be by means of an articulated quarter or cuff rotating in relation to a fixed boot (U.S. Pat. Nos. 5,435,580; 5,435,579; 5,462,296) or by a cable conveyance powered by unspecified means (U.S. Pat. No. 5,211,409; 5,253,882). Although control is improved, activated brakes that use a rubber snub suffer from some of the shortcomings of "toe-up" snub brakes: poor performance, unreliability, and awkwardness.

The third category consists of mechanically activated brakes that arrest the rotation of one or more wheels. These wheel braking systems offer the potential for significantly superior performance and improved control compared to snub brakes. Superior performance stems from the greater friction forces available in the static friction of the rolling wheel contacting the road, compared to the kinetic friction of the scraping snub. Most existing designs of this category provide friction against the soft rubber of the wheels but these designs create rapid wheel erosion and wheel damaging heat because braking force is applied directly to the soft rubber on relatively small areas of the wheel (U.S. Pat. Nos. 5,088,748; 5,374,070; 5,415,419). Wheel brakes of this type are also prone to wheel lock-up because of the use of hard brake surfaces against soft wheel rubber. Other wheel brake systems have avoided braking against the rolling surface of the wheel. One of these, a cuff-activated design (U.S. Pat. No. 5,388,844), is prone to lock-up because it operates on only the rear wheel whereas the skater's weight is distributed over several wheels. Another design, a toe-up system (U.S. Pat. Nos. 5,375,859; 5,401,038), is less prone to lock-up because the skater's weight and his forward momentum are concentrated on one wheel and the activating arm but, like all toe-up systems, is difficult to use and is an awkward configuration entailing a brake appendage mounted behind the rear wheel.

SUMMARY OF THE INVENTION

The device described herein solves the problems and shortcomings enumerated above. In particular, this design creates a braking system that is high performance, meaning it is capable of significantly reduced braking distances compared to other braking systems, yet it is easy enough to be mastered by beginners and skaters of moderate ability and casual interest. It provides a solution to problems of rapid wheel erosion and wheel damaging heat by applying friction between large, hard surfaces. It is also of interest to more accomplished skaters because it requires no motion impeding appendages at the heel or toe, making skating maneuvers easier and less risky. Finally, by providing a means to extend or transfer braking force to multiple load-bearing wheels, it solves the problem of wheel lock-up and flat-spotting that would result if braking force were applied to only one wheel while the skater's load is distributed across several wheels.

The device consists of an in-line roller skate, equipped with a boot shell, and a cuff attached to the shell articulating relative to the shell. The device further consists of a rod connecting the cuff to a lever arm rotating on the rear wheel axle and, in an alternative preferred embodiment, connected in turn to similar lever arms rotating on the axles of a plurality of wheels by means of a transfer lever, and one or more brake discs opposing the braking wheels. To apply the brake during skating, the foot is extended forward resulting in rotation of the cuff relative to the shell. This rotation produces downward movement of the cuff rod relative to the skate frame and wheels, inducing rotation of lever arms. Ramp surfaces on the lever arms contact matching surfaces on the brake discs forcing the brake discs into contact with the rotating wheels, thereby resisting the rearward rotation of the wheels. Braking force may be precisely modulated by increasing or decreasing the rearward rotation of the cuff. To release the brake, the skater returns to normal skating position causing the cuff to rotate forward, eliminating the brake disc contact with the wheels.

BRIEF DESCRIPTION OF THE DRAWINGS

The features and characteristics of the invention will described will be described with reference to the accompanying drawings in which:

FIG. 1 is a side view of the skate embodying the invention;

FIG. 2 is a rear view of the skate embodying the invention in the two-disk brake embodiment;

FIG. 3 is a rear view of the skate, similar to FIG. 2, only showing a second embodiment featuring a single disk brake;

FIG. 4 is a side view of the skate embodying the invention in the normal skating position, with a cutaway showing the details of the skate brake mechanism;

FIG. 5 is a partial cross sectional rear view of the rear wheel and two disk brakes in the normal skating position, taken in the direction of cutting plane 5-5 of FIG. 4;

FIG. 6 is a partial cross sectional rear view of the rear wheel and single disk brake embodiment in the normal skating position, taken in the direction of cutting plane 6-6 of FIG. 4;

FIG. 7 is a side view of the skate embodying the invention, similar to FIG. 4, only showing the brake mechanism in the braking position and the brake mechanism engaged;

FIG. 8 is a partial cross sectional rear view of the rear wheel and two disk brakes in the braking position and the brake mechanism engaged, taken in the direction of cutting plane 8—8 of FIG. 7;

FIG. 9 is a partial cross sectional rear view of the rear wheel and single disk brake embodiment in the braking position and the brake mechanism engaged, taken in the direction of cutting plane 9—9 of FIG. 7;

DETAILED DESCRIPTION OF THE PREFERRED EMBODIMENTS

Figure 10:
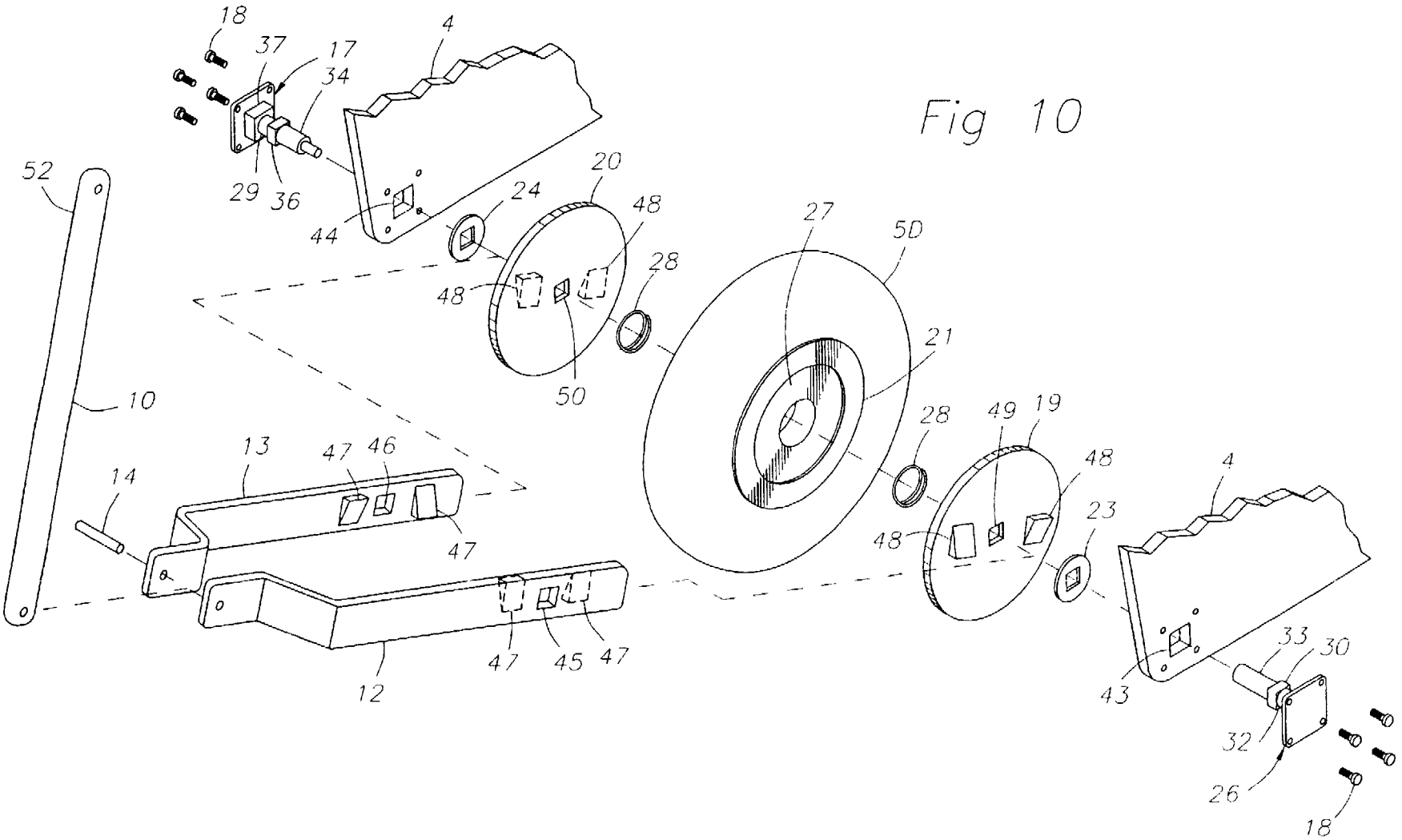
FIG. 10 is an exploded perspective view of the components of the two disk skate brake embodiment.

Referring to FIGS. 1–2, there is shown an in-line roller skate 1, which includes a shell 7, and a skate frame 4 which supports a plurality of wheels, here shown as wheels 5A, 5B, 5C, and 5D. The wheels are rotably mounted to the skate frame 4 by means of axles 8A, 8B, and 8C. A cuff 2, articulated to the shell 7 at attachment point 6, embraces the skater's leg. Clasps 3 are provided for fit adjustment to skater's foot. The wheel brake assembly 39 comprises the mechanism to impart braking force to the wheel 5D as described herein.

Referring to FIG. 1, FIG. 2, FIG. 5, and FIG. 10, the braking wheel 5D, which is in the rearmost location in this embodiment, is mounted to the rear of the skate frame 4 by means of a central axle 9. The central axle 9 comprises two axle halves 17 and 26. These axle halves are attached to the rear portion of the frame 4 by seating keying protrusions 37 and 52 into cutouts 43 and 44 in the skate frame 4. The axle halves 17 and 26 are fastened to frame 4 by means of one or more fastening means such as screws or rivets 18.

The rearmost wheel is mounted to the central axle by means of integral bearings 27 which mount to axle bushing 31. The bushing 31 is fitted loosely to circular axle portions 33 and 34 so as to provide low resistance rotation. It should be noted that although one specific type of ball bearing is illustrated, any usable bearing type is within the purview of the invention.

Two disc-type brakes 19 and 20 are mounted to the non-circular axle portions 30 and 36. These disc brakes are shown having a generally rectangular cross-section. However, a conical or other shaped cross-section is within the purview of the invention. The brake discs have cutouts 49 and 50 that fit over the non-circular axle portions 30 and 36 allowing the disc brakes 19 and 20 to slide axially along the axle halves.

Brake pads 21 and 22, integral to wheel 5D, form annular rings concentric with the central axis of the wheel. The pads are made of a suitable material which has a high friction coefficient and resists heavy wear.

Springs 28 are mounted between the bearings 27 and brake discs 19 and 20. The springs provide a means for applying force to the brake disc preventing the brake disc surfaces and the brake pad surfaces 21 and 22 from contacting each other during normal skating.

Lever arms 12 and 13 are mounted to the circular axle portions 29 and 32. The lever arms have cutouts 45 and 46 that fit over non-circular axle portions 30 and 36. The cutouts are provided for assembly purposes, so the lever arms 12 and 13 may slide over the non-circular axle portions 30 and 36 and rest on circular axle portions 29 and 32. Circular washers 23 and 24 provide a wear-resistant surface against which lever arms 12 and 13 will bear, due to the outward force of the brake discs 19 and 20 generated by the springs 28. Ramp surfaces 47, integral to the lever arms, are located on either side of lever cutouts 45 and 46. These ramps contact mating ramps 48 on the brake discs during brake engagement.

Rod 10 attaches to lever arms 12 and 13 using pin 14 or any suitable means allowing the rod to pivot freely. Upper end 52 of rod 10 pivots at skate cuff 2 using pin 11 or any suitable pivot means.

The operation of the skate brake of the aforementioned embodiment of the invention is as follows. As illustrated in FIGS. 7–8, when the skater rotates the cuff 2 rearward about pivot 6, rod 10 is thrust toward the ground. This downward movement of rod 10 causes brake levers 12 and 13 to rotate counterclockwise about the rear wheel axle 9. The rotation of the lever arms causes the integral lever arm ramp surfaces 47 to contact the ramp surfaces 48 on the brake discs 19 and 20. The contact between ramp surfaces 47 and ramp surfaces 48 causes the brake discs 19 and 20 to slide toward the brake pads 21 and 22 on the wheel 5D laterally along the non-circular axle portions 30 and 36. The opposing force of the brake discs being urged toward the brake pad surfaces 21 and 22 causes lever arms 12 and 13 to bear against washers 23 and 24, which prevent wear directly to the skate frame 4.

The moment generated by the lever arms 12 and 13 bearing counter clockwise on the brake discs is transferred to the non-circular axle portions 30 and 36. The moment will further be transmitted through the axle halves 17 and 26. Fastening means 18 attach the axle halves to the skate frame 4, allowing the skate frame to absorb the moment and prevent the axle assembly 9 from rotating.

As the brake discs 19 and 20 contact the brake pads 21 and 22, the high coefficient of friction between the brake discs and the brake pads causes the rotation of the wheel 5D to slow or stop, which will slow or stop the skater. Since the amount of braking force imparted to the wheel 5D is related to the friction force between the brake pads 21 and 22 and the brake discs 19 and 20, varying the skater's rearward force on the cuff 2 will affect the braking rate.

Referring now to FIG. 4 and FIG. 5, when the skater wishes to resume normal skating, the skater rotates the cuff 2 forward, pulling the rod 10 upwards. This motion causes the brake levers 12 and 13 to rotate clockwise and ramps 47 and 48 to separate. The outward force imparted by springs 28 pushes brake discs 19 and 20 away from the brake pads 21 and 22, allowing wheel 5D to rotate freely.

It should be noted that the brake engagement as described is effected while the skate wheels 5A, 5B, 5C, and 5D remain in contact with the rolling surface 16. This allows the skater to maintain proper control of the skate I while braking.

Alternatively, it may be advantageous to provide braking with only one brake disk, which would provide sufficient braking force yet reduce manufacturing costs for supply as a more economical embodiment.

Figure 11:
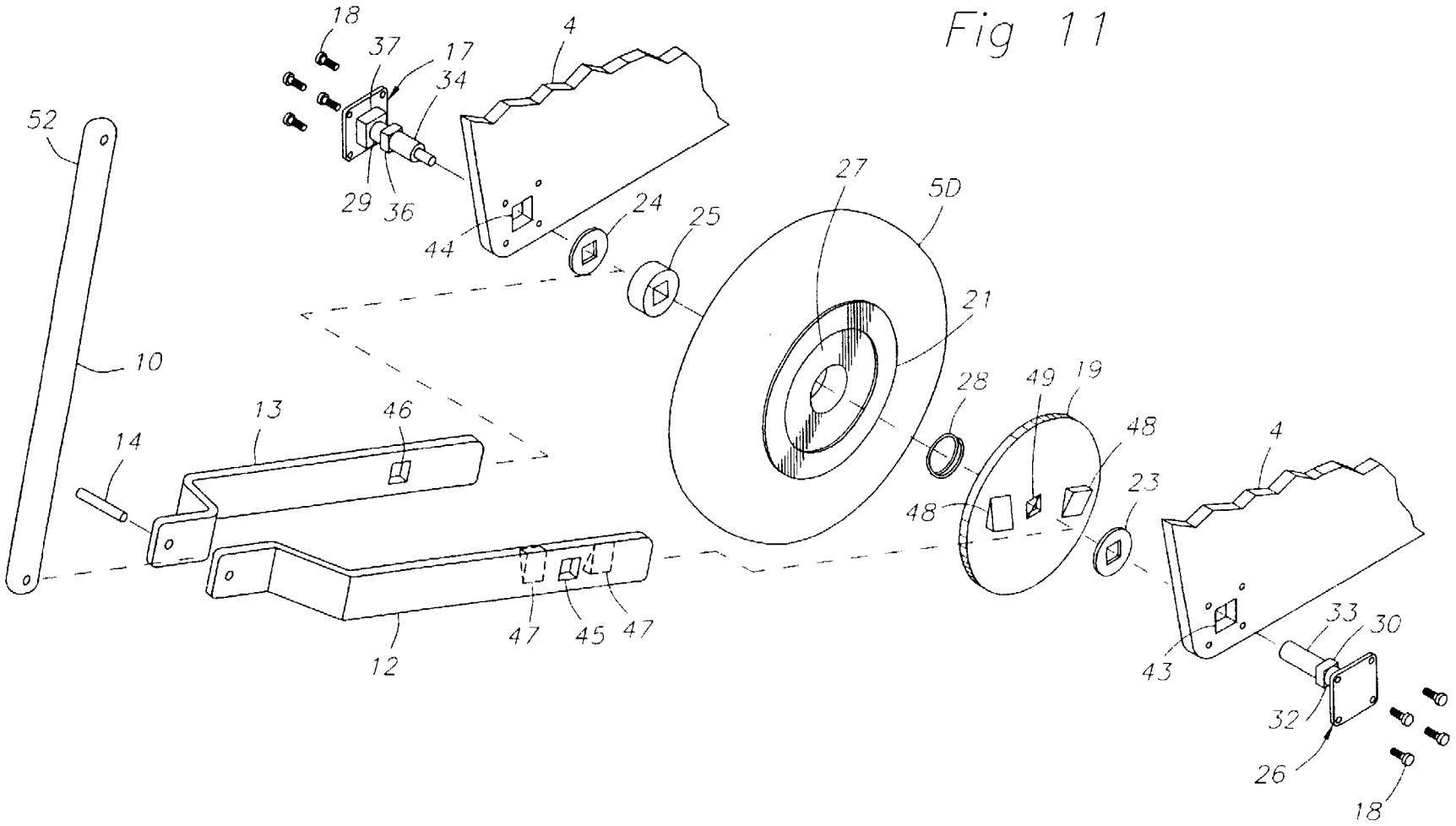
FIG. 11 is an exploded perspective view, similar to FIG. 10, of the components of the single disk skate brake embodiment.

FIGS. 3 and 11 illustrate this further embodiment of the invention where the wheel brake assembly comprises one brake disc 19. A spacer 25 provides proper lateral alignment of brake lever 13 mounted to circular axle portion 29.

Referring now to FIG. 7 and FIG. 9, in the braking operation of the single disc embodiment, the skater rotates the cuff 2 rearward about pivot 6, forcing rod 10 downward. This downward force causes lever arms 12 and 13 to rotate counter-clockwise, urging lever arm ramp surfaces 47 toward brake disk ramp surfaces 48. Brake disc 19 and brake pad 21 are thereby forced to contact each other, and by virtue of the contact friction between the brake disc 19 and the brake pad 21, the rotation of wheel 5D is slowed or stopped.

Referring to FIG. 4 and FIG. 6, when the skater wishes to resume normal skating, the cuff is rotated forward, pulling rod 10 upwards. This motion causes the brake levers 12 and 13 to rotate clockwise and ramps 47 and 48 to separate. The outward force imparted by spring 28 pushes the brake disc 19 away from the brake pad 21, allowing the wheel 5D to rotate freely.

It may also be desirable to provide adjustment means to the braking device allowing the skater to tailor the precise point of brake engagement when a comfortable rotation angle of the cuff is achieved.

Figure 12:
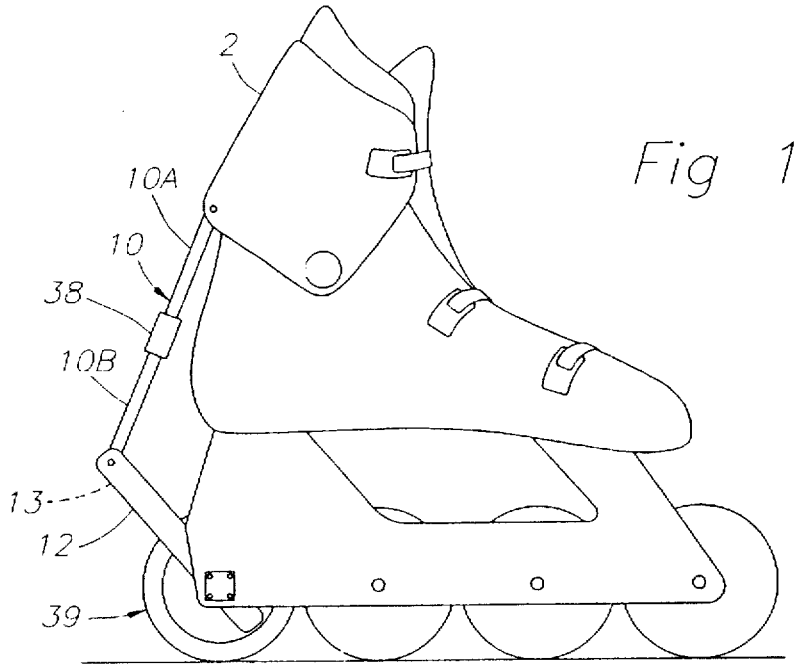
FIG. 12 is a side view of the skate, similar to FIG. 1 of a further embodiment of the braking device provided with a means for adjusting the braking device.
Figure 13:
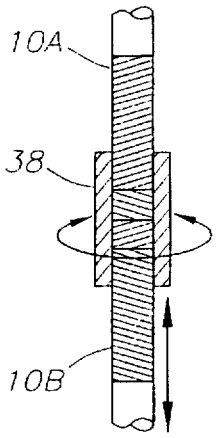
FIG. 13 is a partial cross sectional view of the adjustment means.
Figure 14:
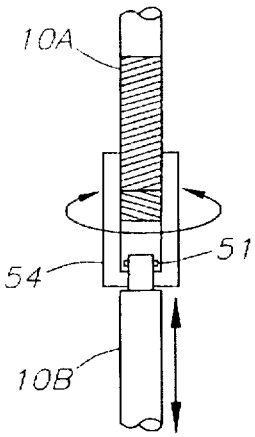
FIG. 14 is a partial cross sectional view, similar to FIG. 13, of a further embodiment of the adjustment means.

This embodiment, as illustrated in FIGS. 12–14, comprises first and second rod members 10A and 10B with opposite threads at ends aligned as facing each other. The adjustment knob 38 has opposing internal threads which are aligned with the threads of rod members 10A and 10B.

As shown specifically in FIG. 13, by rotation the adjustment knob 38, rod members 10A and 10B move closer together or further apart, thereby varying the distance between the cuff 2 and the lever arms 12 and 13.

Alternatively, one of the two rod members 10A and 10B may comprise a threaded end, the other fitting into the adjustment knob 54. Pin 51 provides a seating means to the non-threaded rod 10B inside of the adjustment knob 54.

Figure 15:
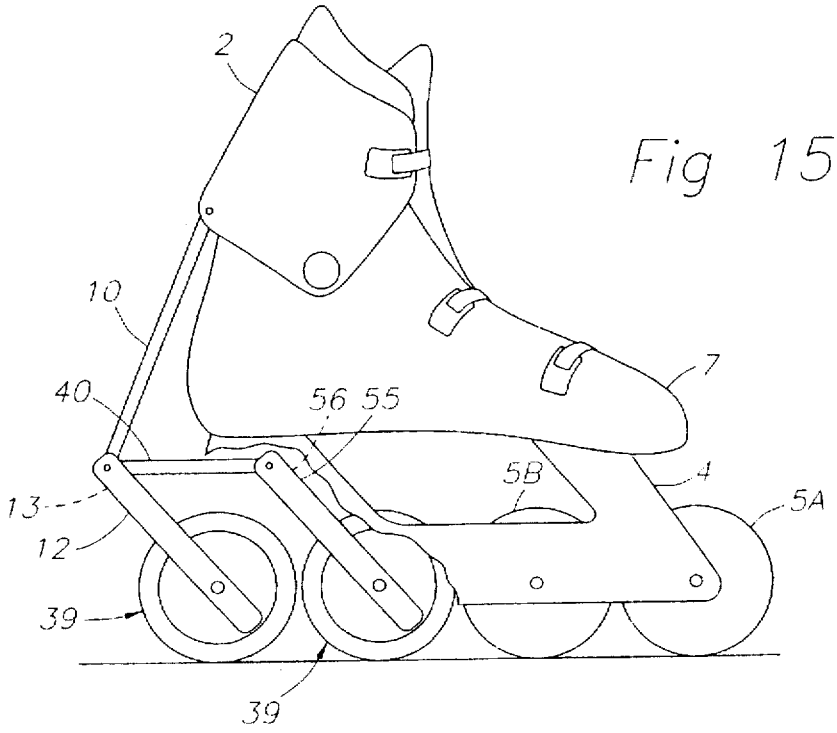
FIG. 15 is a side view of the skate, similar to FIG. 1 of the braking device applied to two wheels.

A further aspect of the invention is illustrated in FIG. 15 comprising a shell 7 mounted to a frame 4 with a cuff 2 articulated to the shell 7. Rod 10 is pivoted to the cuff 2 and the end of lever arms 12 and 13. The lever arms 12 and 13 are articulated to the wheel brake assembly 39 mounted in the rearmost wheel position. Transfer lever 40 is pivoted at the end of lever arms 12 and 13 and at the end of lever arms 55 and 56 which are articulated to the wheel brake assembly 39 mounted in the second most rearward wheel position. Nonbraking wheels 5A and 5B are conventionally mounted to the skate frame 4.

The use of the braking device is as follows: the skater imparts a rearward motion to the cuff 2 causing rod 10 to move downward. As the rod 10 moves downward, by virtue of the connection of rod 10, lever arms 12 and 13, 55 and 56, and transfer lever 40, lever arms 12 and 13 and 55 and 56 rotate counter-clockwise. This rotation causes the wheel brake assemblies 39 to engage and effect a stop for the skater.

When the skater wishes to resume normal skating, the cuff 2 is rotated forward, pulling rod 10 upwards. This causes brake levers 12, 13, 55, and 56 to rotate clockwise, thus eliminating the braking effect.

It should be understood that either a two disc or a single disc brake mechanism may be used to brake any of the two braking wheels in this embodiment.

Figure 16:
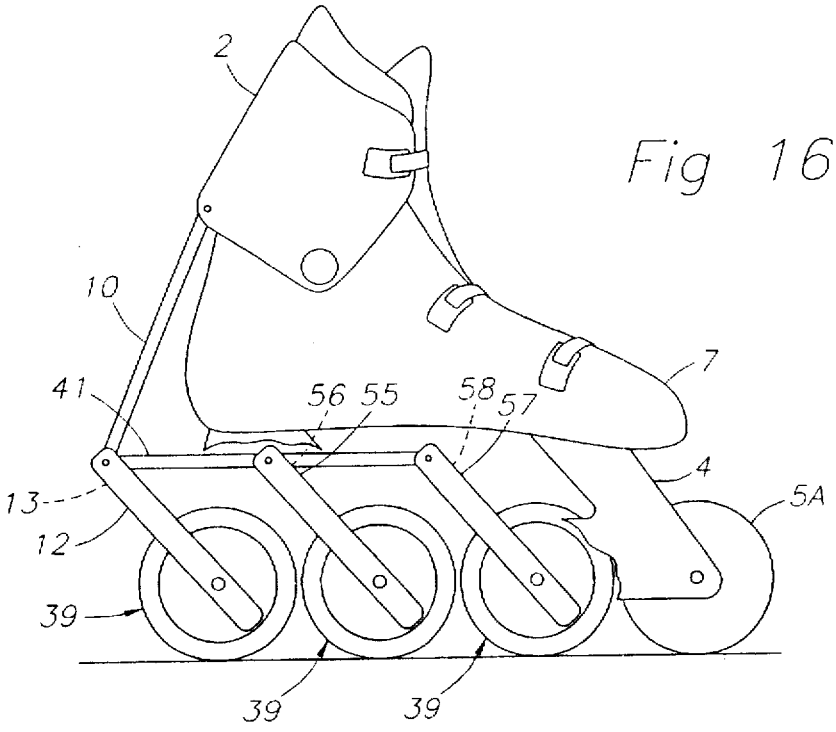
FIG. 16 is a side view of the skate, similar to FIG. 1 of the braking device applied to three wheels.

Yet a further aspect of the invention is illustrated in FIG. 16 comprising a shell 7 mounted to a frame 4 with a cuff 2 articulated to the shell 7. Rod 10 is pivoted to the cuff 2 and the end of lever arms 12 and 13. The lever arms 12 and 13 are articulated to the wheel brake assembly 39 mounted in the rearmost wheel position. Transfer lever 41 is pivoted at the end of lever arms 12 and 13, at the end of lever arms 55 and 56, and at the end of lever arms 57 and 58. Lever arms 55 and 56 are articulated to the wheel brake assembly 39 mounted in the second most rearward wheel position. Lever arms 57 and 58 are articulated to the wheel brake assembly 39 mounted in the second most forward wheel position. The nonbraking wheel 5A is conventionally mounted to the skate frame 4.

The use of the braking device is as follows: the skater imparts a rearward motion to the cuff 2 causing rod 10 to move downward. As the rod 10 moves downward, by virtue of the connection of rod 10, lever arms 12 and 13, 55 and 56, 57 and 58, and transfer lever 41, lever arms 12 and 13, lever arms 55 and 56, and lever arms 57 and 58 rotate counter-clockwise. This rotation causes the wheel brake assemblies 39 to engage and effect a stop for the skater.

When the skater wishes to resume normal skating, the cuff 2 is rotated forward, pulling rod 10 upwards. This causes brake levers 12 and 13, 55 and 56, and 57 and 58 to rotate clockwise, thus eliminating the braking effect.

It should be understood that either a two disc or a single disc brake mechanism may be used to brake any of the three braking wheels in this embodiment.

Figure 17:
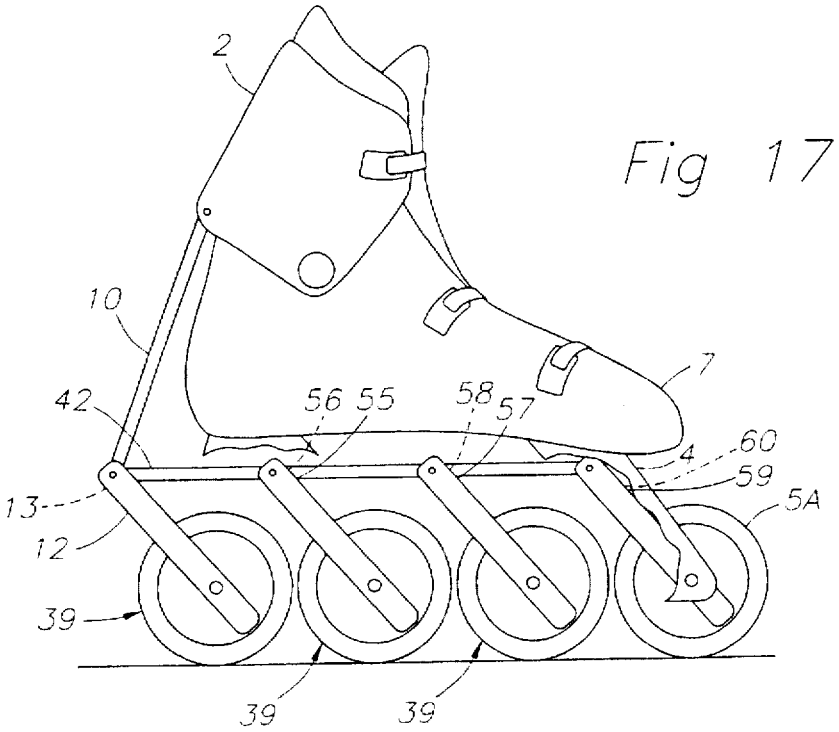
FIG. 17 is a side view of the skate, similar to FIG. 1 of the braking device applied to four wheels.

A further aspect of the invention is illustrated in FIG. 17 comprising a shell 7 mounted to a frame 4 with a cuff 2 articulated to the shell 7. Rod 10 is pivoted to the cuff 2 and the end of lever arms 12 and 13. The lever arms 12 and 13 are articulated to the wheel brake assembly 39 mounted in the rearmost wheel position. Transfer lever 42 is pivoted at the end of lever arms 12 and 13, at the end of lever arms 55 and 56, at the end of lever arms 57 and 58, and at the end of lever arms 59 and 60. Lever arms 55 and 56 are articulated to the wheel brake assembly 39 mounted in the second most rearward wheel position. Lever arms 57 and 58 are articulated to the wheel brake assembly 39 mounted in the second most forward wheel position. Lever arms 59 and 60 are articulated to the wheel brake assembly 39 mounted in the most forward wheel position.

The use of the braking device is as follows: the skater imparts a rearward motion to the cuff 2 causing rod 10 to move downward. As the rod 10 moves downward, by virtue of the connection of rod 10, lever arms 12 and 13, 55 and 56, 57 and 58, 59 and 60, and transfer lever 42, lever arms 12 and 13, lever arms 55 and 56, lever arms 57 and 58, and lever arms 59 and 60 rotate counter-clockwise. This rotation causes the wheel brake assemblies 39 to engage and effect a stop for the skater.

When the skater wishes to resume normal skating, the cuff 2 is rotated forward, pulling rod 10 upwards. This causes brake levers 12 and 13, 55 and 56, 57 and 58, and 59 and 60 to rotate clockwise, thus eliminating the braking effect.

It should be understood that either a two disc or a single disc brake mechanism may be used to brake any of the four braking wheels in this embodiment.

Figure 18:
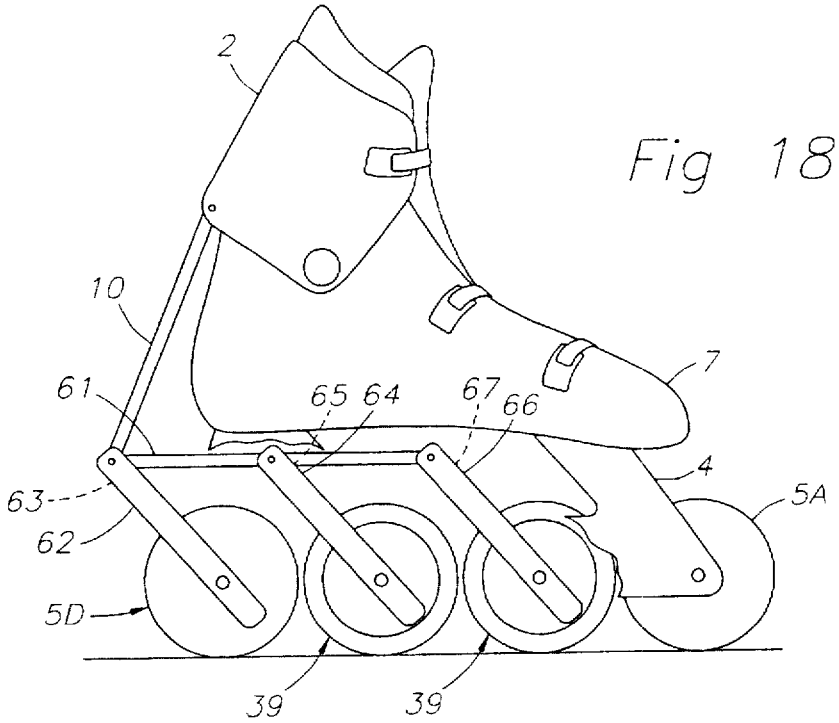
FIG. 18 is a side view of the skate, similar to FIG. 1 of the braking device applied to the two central wheels.

A further aspect of the invention is illustrated in FIG. 18 comprising a shell 7 mounted to a frame 4 with a cuff 2 articulated to the shell 7. Rod 10 is pivoted to the cuff 2 and the end of lever arms 62 and 63. The lever arms 62 and 63 are articulated to the rear wheel axle. Transfer lever 61 is pivoted at the end of lever arms 62 and 63, at the end of lever arms 64 and 65, and at the end of lever arms 66 and 67. Lever arms 64 and 65 are articulated to the wheel brake assembly 39 mounted in the second most rearward wheel position. Lever arms 66 and 67 are articulated to the wheel brake assembly 39 mounted in the second most forward wheel position.

The use of the braking device is as follows: the skater imparts a rearward motion to the cuff 2 causing rod 10 to move downward. As the rod 10 moves downward, by virtue of the connection of rod 10, lever arms 62 and 63, 64 and 65, and transfer lever 61, lever arms 62 and 63, lever arms 64 and 65, and lever arms 66 and 67 rotate counterclockwise. This rotation causes the wheel brake assemblies 39 to engage and effect a stop for the skater.

When the skater wishes to resume normal skating, the cuff 2 is rotated forward, pulling rod 10 upwards. This causes brake levers 62 and 63, 64 and 65, and 66 and 67 to rotate clockwise, thus eliminating the braking effect.

It should be understood that either a two disc or a single disc brake mechanism may be used to brake any of the two braking wheels in this embodiment.

What is claimed is:

1. A braking device for an in-line roller skate having a boot, a cuff articulated to the boot, a wheel frame attached to the boot and at least one wheel attached to said frame, said device comprising:

a rod member having a first end and a second end, said first end articulated to said cuff;

at least one lever arm having a first end and a second end, said first end being attached in a rotatable manner to an axle holding said at least one wheel, and said second end articulated to said second end of said rod member;

said axle positioned on a central axis of said at least one wheel, said axle being rigidly fastened to said frame;

at least one brake plate positioned for lateral movement along said axle between said first end of said at least one lever arm and said at least one wheel;

engaging means between said at least one brake plate and said at least one lever arm for inducing contact between said at least one brake plate and said at least one wheel upon rearward rotation of said at least one lever arm as said cuff is articulated to provide braking; and a means for applying force positioned between said at least one wheel and said at least one brake plate providing outward pressure between said at least one wheel and said at least one brake plate so as to prevent contact of said at least one brake plate with said at least one wheel to allow free rotation of said at least one wheel.

2. The device of claim 1, wherein said axle has a circular cross-section where said first end of said at least one lever arm is attached to said axle allowing free rotation of said at least one lever arm about said axle, and wherein said axle has a non-circular crosssection where said at least one brake plate is attached to said axle allowing lateral movement of said at least one brake plate while preventing rotation of said at least one brake plate about said axle.

3. The device of claim 1, wherein said at least one wheel has a brake bearing surface on an outer surface facing said at least one brake plate so as to provide friction between said at least one brake plate and said brake bearing surface during contact therebetween to prevent excessive wear on said at least one wheel after repeated braking actions.

4. The device of claim 1, wherein said engaging means comprises raised ramp surfaces for inducing the lateral movement of said at least one brake plate along said axle.

5. The device of claim 1, wherein said means for applying force to provide outward pressure between said at least one wheel and said at least one brake plate comprises a spring means.

6. The device of claim 1, wherein said at least one lever arm comprises a first and second lever arm arranged in a forked configuration.

7. The device of claim 1, further comprising adjustment means for adjusting a length of said rod member.

8. The device of claim 7, wherein said adjustment means comprises an internally threaded collar into which an externally threaded first and second segment of said rod member is threaded and interacts as said internally threaded collar is rotated.

9. The device of claim 7, wherein said adjustment means comprises a collar internally threaded at one end accommodating said externally threaded first segment of said rod member, said internally threaded collar being unthreaded at an other end, said unthreaded end having a small opening accommodating an end of said second segment of said rod member where said second segment of said rod member is held in place with a pin.

10. A braking device for an in-line roller skate, said skate having a cuff articulated to a shell accepting a skater's foot, whereby said cuff is attached to said shell by a pivoting means allowing said cuff to be rotatable longitudinally about an axis lateral to said skater's foot, and having at least one wheel attached to said shell, comprising:

a rod member articulated to said cuff in such a manner as to allow said rod member to pivotally interact with said cuff, whereby said rod member extends downward behind said cuff and said shell;

at least one lever arm having a first end rotatable about a central axis of said at least one wheel and a second end of said lever arm pivotally articulated to said rod member whereby said second end of lever arm is forced downward as said cuff is rotated rearward and said second end of lever arm is forced upward as said cuff is rotated forward;

an axle positioned on said central axis of said at least one wheel, said axle being rigidly fastened to a frame on said shell so as to prevent rotation of said axle relative to said frame;

at least one brake plate positioned for lateral movement along said axle between said first end of said at least one lever arm and said at least one wheel positioned on said central axis;

engaging means between said at least one brake plate and said at least one lever arm for inducing contact of said at least one brake plate and said at least one wheel providing braking;

a means for applying force positioned between said at least one wheel and said at least one brake plate providing outward pressure between said at least one wheel and said at least one brake plate;

said axle having a circular cross-section where said first end of said at least one lever arm is attached to said axle allowing free rotation of said lever arm about said axle;

said axle further having a non-circular cross-section where said at least one brake plate is attached to said axle allowing lateral movement of said at least one brake plate while preventing rotation of said at least one brake plate about said axle;

said at least one wheel having a brake bearing surface on an outer surface facing said at least one brake plate so as to provide friction between said at least one brake plate and said brake bearing surface and to prevent excessive wear on said wheel after repeated braking actions;

said at least one brake plate and said first end of said at least one lever arm further having raised ramp surfaces for converting rearward rotation of said at least one lever arm as said cuff is rotated rearwardly, into axial movement of said at least one brake plate.

11. The device of claim 10, wherein a means is provided to adjust a length of said rod member.

12. The device of claim 11, wherein said length adjustment means comprises an internally threaded collar into which the externally threaded first and second segments of said rod member are threaded and may interact as said collar is rotated.

13. The device of claim 11, wherein said length adjustment means comprises a collar internally threaded at one end accommodating said externally threaded first segment of said rod member, said collar being unthreaded at the other end, said unthreaded end having a small opening accommodating the end of said second segment of said rod member where said second segment of said rod member is held in place with a pin.

14. The device of claim 1, where said braking device is located on a rearmost wheel of said in-line roller skate.

15. The device of claim 1, having two or more wheels wherein said braking device is articulated to a rearmost wheel.

16. The device of claim 1, having two or more wheels wherein a braking device is attached to each of said two or more wheels.

17. The device of claim 16, wherein said braking devices on said two or more wheels are interengaged by a transfer lever means.

18. The device of claim 1, having three or more wheels wherein a braking device is attached to at least two of said wheels other than a rearmost wheel.

19. The device of claim 18, wherein said braking devices are interengaged by a transfer lever means.

* * * * *